US008505842B2

(12) United States Patent
Fornasier et al.

(10) Patent No.: US 8,505,842 B2
(45) Date of Patent: Aug. 13, 2013

(54) MIXING MACHINE FOR HOMOGENISING A LIQUID MIXTURE CONTAINING BITUMEN WITH SOLID GRANULES

(75) Inventors: Antonio Fornasier, San Biagio di Callalta (IT); Alessandro Pavan, Lanzago di Silea (IT)

(73) Assignee: Euroline S.R.L., Maserada Sul Piave (IT)

( * ) Notice: Subject to any disclaimer, the term of this patent is extended or adjusted under 35 U.S.C. 154(b) by 491 days.

(21) Appl. No.: 12/618,642

(22) Filed: Nov. 13, 2009

(65) Prior Publication Data

US 2010/0127106 A1 May 27, 2010

(30) Foreign Application Priority Data

Nov. 13, 2008 (IT) ..... TO2008A0839

(51) Int. Cl.
*B02C 4/10* (2006.01)

(52) U.S. Cl.
USPC ..... 241/66; 241/131; 241/228

(58) Field of Classification Search
USPC ..... 241/228, 129, 131, 107, 66
See application file for complete search history.

(56) References Cited

U.S. PATENT DOCUMENTS

| | | | | |
|---|---|---|---|---|
| 1,349,235 | A * | 8/1920 | Stout | 241/129 |
| 3,027,103 | A | 3/1962 | Mischanski | |
| 3,156,451 | A | 11/1964 | Waas | |
| 5,683,178 | A | 11/1997 | Nakamoto et al. | |
| 2004/0136263 | A1 | 7/2004 | Backhaus | |

FOREIGN PATENT DOCUMENTS

| | | |
|---|---|---|
| CH | 406 149 | 1/1966 |
| DE | 196 40 740 A1 | 4/1998 |
| EP | 0 538 065 A1 | 4/1993 |
| EP | 0 598 253 | 5/1994 |
| FR | 2 477 429 | 9/1981 |
| GB | 628 891 | 9/1949 |
| GB | 1 328 724 | 8/1973 |
| GB | 2 091 586 | 8/1982 |
| JP | 62057636 | 3/1987 |
| JP | 01022332 | 1/1989 |
| WO | WO 2008/096248 | 8/2008 |

OTHER PUBLICATIONS

European Search Report for European Application No. 09176010.8 containing Communication relating to the Results of the European Search Report, 9 pgs., (Feb. 19, 2010).
Italian Search Report for Italian Application No. TO20080839, 3 pgs (Oct. 5, 2009).

* cited by examiner

*Primary Examiner* — Faye Francis
(74) *Attorney, Agent, or Firm* — Blakely, Sokoloff, Taylor & Zafman LLP

(57) ABSTRACT

A mixing machine adapted to mix a liquid mixture containing bitumen with solid granules so as to obtain a homogenized bituminous mix. The machine includes a cylindrical container arranged coaxially to a vertical axis and capable of containing the liquid mixture containing bitumen and the solid granules, a heating circuit for heating the inner side surface of the cylindrical container, a mixing assembly mounted axially rotatable within the container to rotate about the vertical axis, and a driving unit adapted to rotate the mixing assembly about the vertical axis. The mixing assembly includes a helicoidal blade which extends coaxial to the axis within the container and has its outer peripheral edge in contact with the inner surface of the container so as to scrape the material adhering on the inner surface during its rotation.

7 Claims, 4 Drawing Sheets

MIXING MACHINE FOR HOMOGENISING A LIQUID MIXTURE CONTAINING BITUMEN WITH SOLID GRANULES

The present invention relates to a mixing machine for homogenising a liquid mixture containing bitumen and solid granules.

More in detail, the present invention relates to a vertical axis mixing machine structured to mix a liquid mixture containing bitumen with a powder filler and solid granules made of polymeric material and/or resin-based and/or plastic material-based and/or rubber material and/or similar materials, and having the function of crushing the solid granules so as to obtain a homogenous liquid bituminous mix in order to obtain a homogenous bituminous liquid mix; to which the following description will explicitly refer without therefore loosing in generality.

BACKGROUND OF THE INVENTION

Mixing machines for bitumen are known, comprising a cylindrical container for containing liquid bitumen, filler and solid granules to be mixed, which is developed along a vertical longitudinal axis and typically has a side air space and a bottom air space within which a serpentine is arranged, which is adapted to circulate high-temperature diathermic oil for heating the side wall and the bottom wall of the container.

Furthermore, mixing machines comprise a central auger, which is arranged within the container in a position which is coaxial to the longitudinal axis and is coupled thereto in order to freely rotate about the longitudinal axis itself; and a drive shaft which is at least partially arranged within the container in a position which is coaxial to the longitudinal axis, and is actuated by an electric motor, placed outside the container itself, in order to rotate the auger about the longitudinal axis so as to determine the mixing of the liquid bitumen with the solid granules so as to obtain a liquid bituminous mix.

More in detail, the above-described auger is structured so that the distance between its crest and the vertical longitudinal rotation axis is less than the inner diameter of the container. In use, the fluid mass present in the middle of the container is pushed downwards by the auger while being heated up by receiving heat from the bottom and side walls. The heating caused on fluid mass and solid granules determines, on one hand, a dissolution of the granules and, on the other hand, generates a convective motion which pushes the mass upwards thus determining, along with the forced motion generated by the auger, the bituminous material and dissolved granules mixing up.

The above-described mixing machines have various technical drawbacks.

Firstly, the dissolution of the solid granules may be obtained only by generating/transmitting high amounts of heat on/from the surfaces of the container, the latter being a particularly disadvantageous condition because a great amount of energy is employed for heating the diathermic oil and thus it negatively affects the total production costs of the bituminous mix.

Furthermore, the above-described mixing machine is not very efficient when mixing solid granules characterized by a particularly high specific weight. Indeed, in this case, due to their weight the solid granules tend to deposit on the bottom wall of the container, not mixing homogenously with the remaining bituminous mix.

In addition, the above-described mixing machine is not very efficient whenever solid granules characterized by a series of inner impurities having a high toughness need to be mixed. Indeed, in this case, the complete dissolution of the granule and impurities may be obtained only by considerably increasing the thermal energy and extending homogenisation times, i.e. the working times of the auger. Unfortunately, both these conditions determine prohibitive energy costs. In addition, whenever the aforesaid complete dissolution condition is not achieved, solid impurities are deposited inside the bituminous mix which causes a weakening and a thus a deterioration of the inner structure thereof.

SUMMARY OF THE INVENTION

It is an object of the present invention to provide a mixing machine for homogenising the bituminous liquid material with solid granules which is capable of overcoming the above-described drawbacks.

According to the present invention, a mixing machine is provided for homogenising liquid bituminous material containing solid granules as claimed in the attached claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
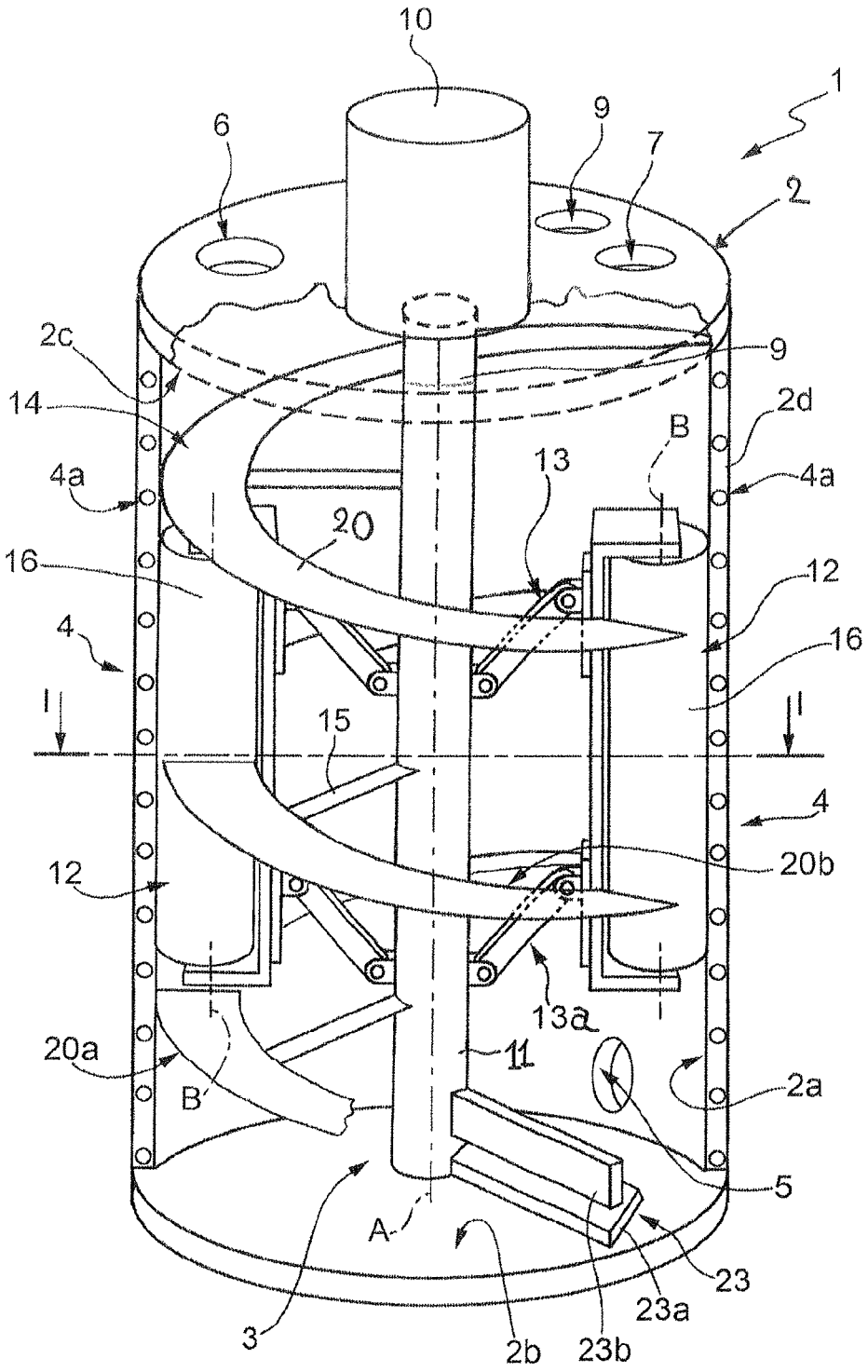
FIG. 1 is a side perspective view with parts in section and parts removed for clarity of a mixing machine for homogenising liquid bituminous material with solid granules implemented according to the dictates of the present invention.
Figure 2:
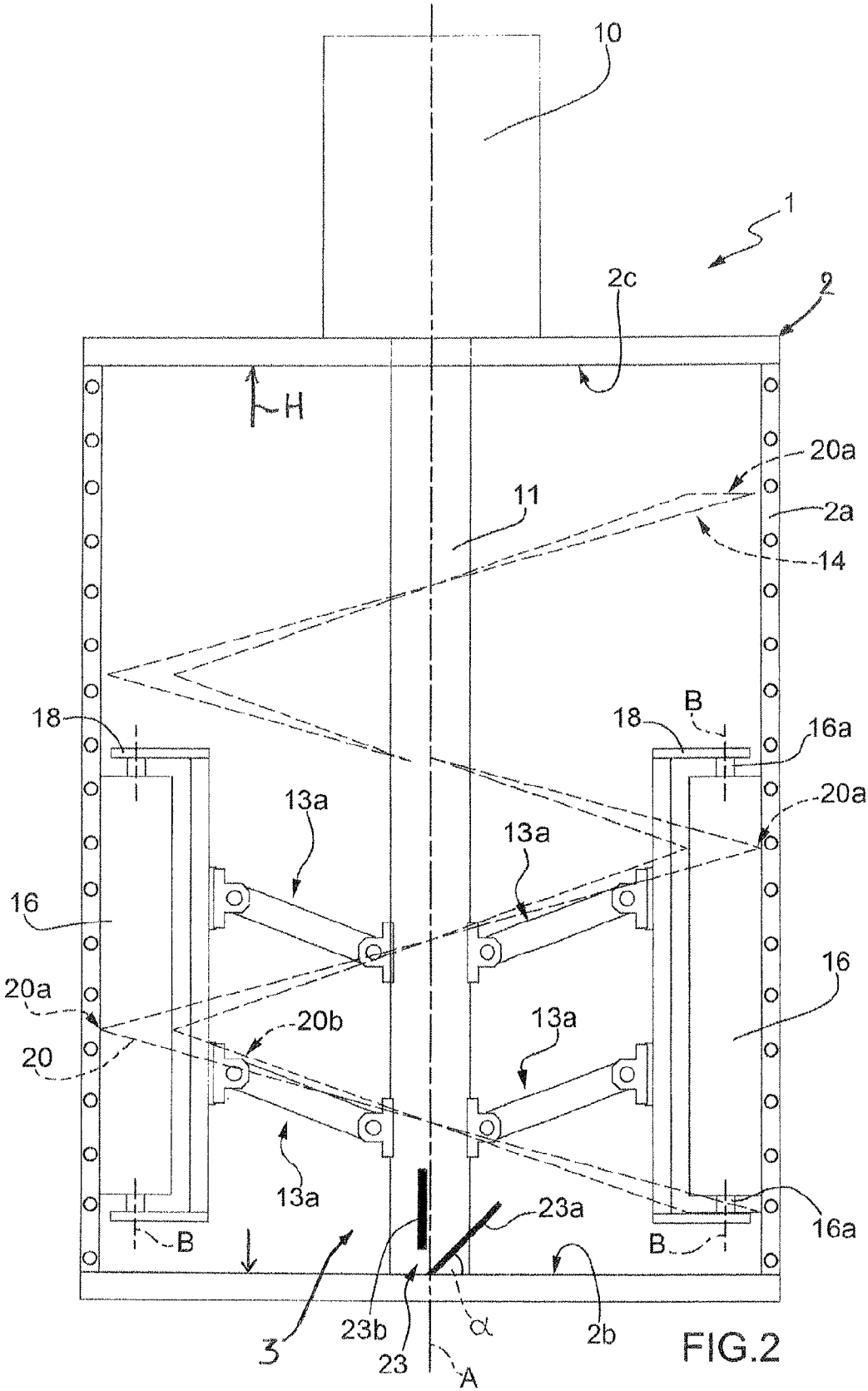
FIG. 2 is a front elevation view with parts in section and parts removed for clarity of the mixing machine shown in FIG. 1.
Figure 3:
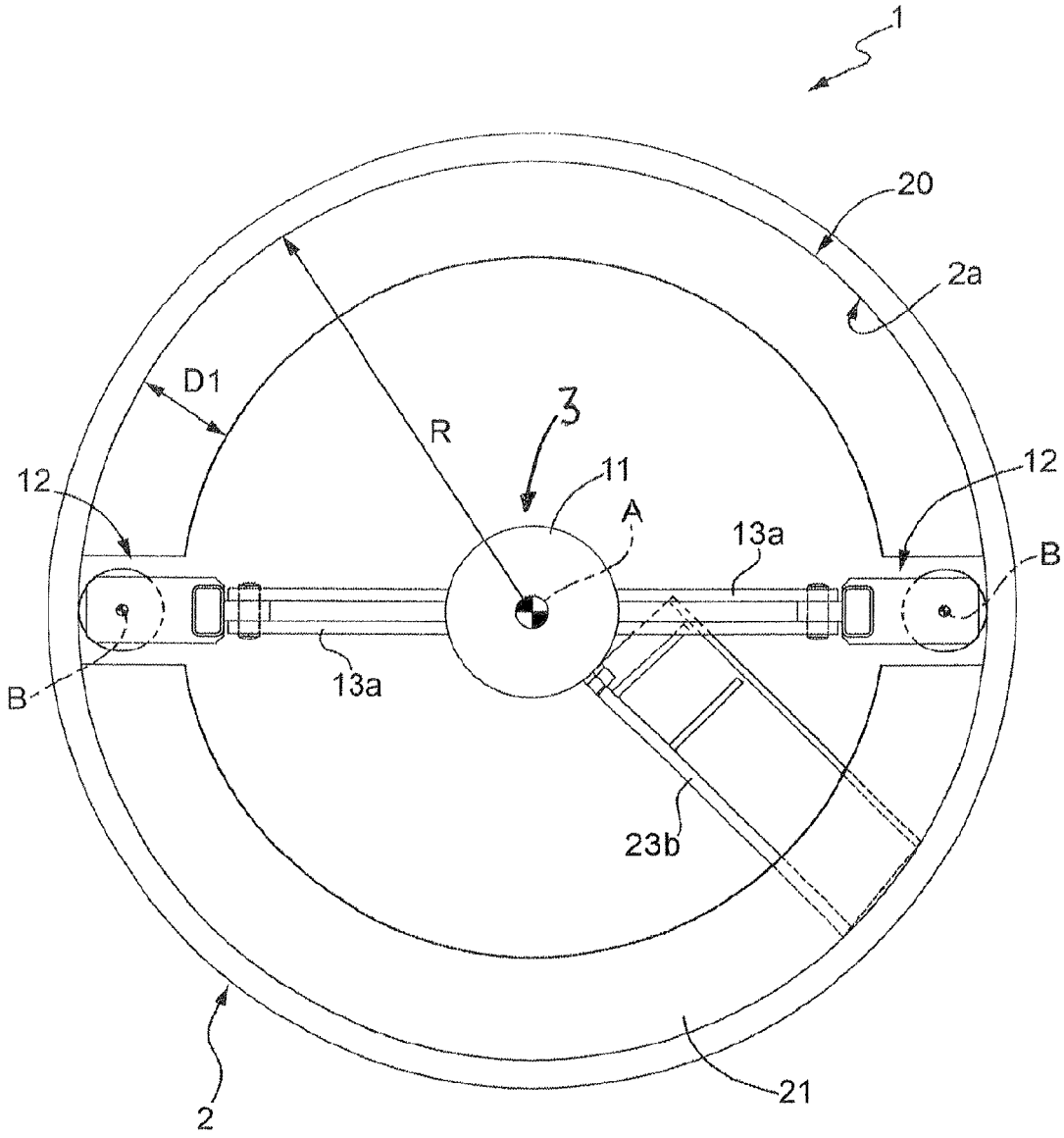
FIG. 3 depicts the mixing machine shown in FIG. 1 taken along section I-I; while FIG. 4 diagrammatically shows the movement imparted to the bituminous mix by the mixing assembly of the machine shown in FIG. 1.

With reference to FIGS. 1, 2 and 3, number 1 indicates as a whole a mixing machine, which is structured for homogenising a series of components such as in particular a liquid mixture containing bitumen, a powder filler and solid granules with one another, in order to produce a bituminous mix adapted to make insulating films, applicable in the field of constructions for serving protective and/or insulating functions.

While mixing, machine 1 is further capable of mechanically crushing the solid granules so as to pulverize them and conveniently adapt them for homogenisation with the remaining components included in the bituminous mix.

In particular, machine 1 is adapted to homogenise a mixture containing bitumen with solid granules of polymeric type preferably, but not necessarily, containing resin and/or plastic materials and/or rubber material and/or any other similar material.

With reference to FIG. 1, mixing machine 1 essentially comprises a container 2 which is developed along a vertical axis A and is structured so as to contain the above-described components of the bituminous mix, and a mixing assembly 3, which is mounted in an axially rotational manner within the container 2 to rotate about the axis A, and is structured for mechanically crushing solid granules against the inner side surface 2*a* of the container 2 so as to crumble and pulverize them, and to displace at least one portion of the mass of bituminous mix present at the surface 2*a* of the container 2, from the bottom surface 2*b* of the container 2 to the upper surface 2*c* opposite thereto, so as to mix the bituminous mix.

With reference to FIG. 1, the collection container 2 is defined by a metal container, e.g. made of steel or any other similar metal, is cylindrical in shape and integrates a heating circuit 4 within a side wall 2*d* thereof serving the function of transmitting heat to the inner surface 2*a* of the container 2 so as to rise the temperature of the bituminous mix contained therein.

The heating circuit 4 is of known type and therefore it will not be described in further detail except for specifying that it comprises a series of heating pipes 4*a* within which a heated fluid circulates, e.g. diathermic oil, adapted to yield a given amount of heat to the inner surface 2*a* of the side wall 2*d* of container 2 so as to keep the homogenised bituminous mix at a predetermined temperature.

The following are further obtained on the body of container 2: an unloading opening 5 connected to an unloading pipe (not shown), through which the homogenised bituminous mix is conveyed outwards container 2; an opening 6 connected to an outer pipe (not shown), adapted to load the filler into container 2; an opening 7 connected to an outer pipe (not shown), adapted to load the liquid mixture containing bitumen into container 2; and finally a loading opening 9 or mouth, through which the solid granules are loaded into container 2.

On the other hand, the mixing assembly 3 is rotated by a central drive shaft 9, which is partially arranged within the container 2 in a position coaxial to the axis A and is connected to the outlet shaft by a driving unit 10, e.g. an electric motor, preferably but not necessarily arranged outside the container 2.

The mixing assembly 3 further comprises a central hub 11 stably fitted onto the drive shaft 9, one or more crushing device 12 which are connected to the central hub 11 by mechanical leverages 13 and are structured to crush the solid granules against the cylindrical surface 2*a* of the container 2 so as to crumble/pulverize them, and a scraping member 14 which is connected to the central hub 11 through a series of radial support arms 15, and serves the function of both scraping the bituminous mix, and in particular the crumbled solid granules adhering onto the inner surface 2*a* of the container 2, and pushing the bituminous mix present close to the surface 2*a* towards the upper surface 2*c* of the container 2.

More in detail, in the example shown in FIG. 1, the mixing assembly 3 comprises a plurality of crushing devices 12, which are arranged within the container 2 being angularly spaced from one another about the axis A, and each comprising a pressure roller 16, which is arranged in abutment with the outer cylindrical surface thereof on the surface 2*a* of the container 2 and is mounted in an axially rotational manner on the free end of the corresponding mechanical leverage 13 so as to be able to rotate in contact with the surface 2*a* itself, about a corresponding axis B parallel to axis A, so as to crumble the solid granules against the surface 2*a* itself during its rotation.

In the example shown in FIG. 2, each pressure roller 16 is preferably but not necessarily made of metal material, and has a pair of pins 16*a* on its ends, which are hinged by interposing corresponding bearings on the free ends of a substantially C-shaped support bar stably connected to the end of the mechanical leverage 13.

More in detail, in the example shown in FIG. 2, the mechanical leverage 13 is structured so as to have a pair of radial support arms 13*a* vertically spaced from each other, which have the respective axial ends hinged onto the support bar 18 and on the central hub 11, respectively, so as to be arranged to be parallel and coplanar to each other and to define an articulated quadrilateral which allows the support bar 18 to move on a radial plane passing through the axis A, to and from the inner surface 2*a* of container 2.

In this case, in the example shown in FIGS. 1 and 2, the radial support arms 13*a* are arranged so as to be significantly inclined upwards from the central hub 11 and outwards, so that the pressure roller 16 is kept resting with the outer cylindrical surface thereof on the surface 2*a* under the bias of its own weight.

Furthermore, according to a possible embodiment, the mechanical leverage 13 may further comprise a pushing device (not shown) which is adapted to be interposed between the central hub 11 and the support bar 18 and is adapted to exert a radial force on the support bar 18, capable of keeping the pressure roller 16 constantly abutting on the inner surface 2*a* of the container 2 so as to crush the solid granules against the surface 2*a* itself.

In particular, the pushing device may comprise at least one spring interposed between the support bar 18 and the central hub 11. It is worth specifying that the spring of the pushing device exerts a predetermined elastic force on the bar 18 which may be changed by means of an adjusting member (not shown) provided in the pushing device. It is apparent that the adjustment of the elastic constant of the spring made by means of the adjusting member advantageously allows to appropriately change the compression exerted by the pressure roller 16 on solid granules and bituminous material according to the type of solid granules used in the bituminous mix.

The scraping member 14 comprises a helicoidal blade 20 preferably but not necessarily consisting of a metal strap, which extends into the container 2 in a position coaxial to the axis A according to a helicoidal curve so as to have the outer peripheral edge 20*a* thereof in contact with the inner surface 2*a* so as to be able, in use, to scrape the pulverized granules and/or bituminous material and/or filler adhering onto the inner surface 2*a* due to the crushing/pressing operation performed by the pressure rollers 16.

Furthermore, the helicoidal blade 20 is shaped so as to have the inner peripheral edge 20*b* thereof spaced from axis A so as to delimit therewith, during the rotation, a cylindrical inner volume of non-interference between the helicoidal blade 20 and the bituminous mix contained in container 2.

In the example shown in FIG. 1, the helicoidal blade 20 is developed along axis A so as to substantially cover the whole height H of the container 2, vertically measured along axis A, and has a width D1 which is smaller than the radius R of container 2.

More in detail, in the example shown in FIG. 3, the helicoidal blade 20 comprises a number of straps or flat segments 21, which are arranged one after the other according to a helicoidal curve, are stably joined to one another at their corresponding ends and are intercalated between the pressure rollers 16.

In the example shown in FIG. 1, the bottom surface 2*b* of container 2 is flat and coplanar to a plane orthogonal to axis A, while the scraping member 14 comprises a scraper blade 23, which is stably connected with one end thereof onto the lower end of the central hub 11 and is arranged resting on the bottom surface 2*b* of container 2 so as to be able to scrape the bituminous mix and/or the components deposited on the surface 2*b* itself.

The scraper blade 23 orthogonally extends to axis A and is shaped so as to have a scraping portion 23*a*, which is defined by a substantially rectangular, preferably but not necessarily metal plate, arranged to be inclined by a predetermined angle $\alpha$ with respect to the laying plane of the bottom surface 2*b* of container 2, and is adapted to scrape the bottom surface 2*b* by the its lower edge, during the rotation of the central hub 11.

The scraper blade 23 extends orthogonally to axis A and is shaped so as to have a mixing portion 23*b*, which is defined by a substantially rectangular, preferably but not necessarily metal plate, arranged to be spaced and perpendicular from/to the laying plane of the bottom surface 2*b* of container 2, and is adapted to mix the scraped bituminous mix with the remaining bituminous mix, during the rotation of the central hub 11.

In use, the components of the bituminous mix, i.e. bituminous liquid mixture, filler and solid granules, are loaded on container 2.

Figure 4:
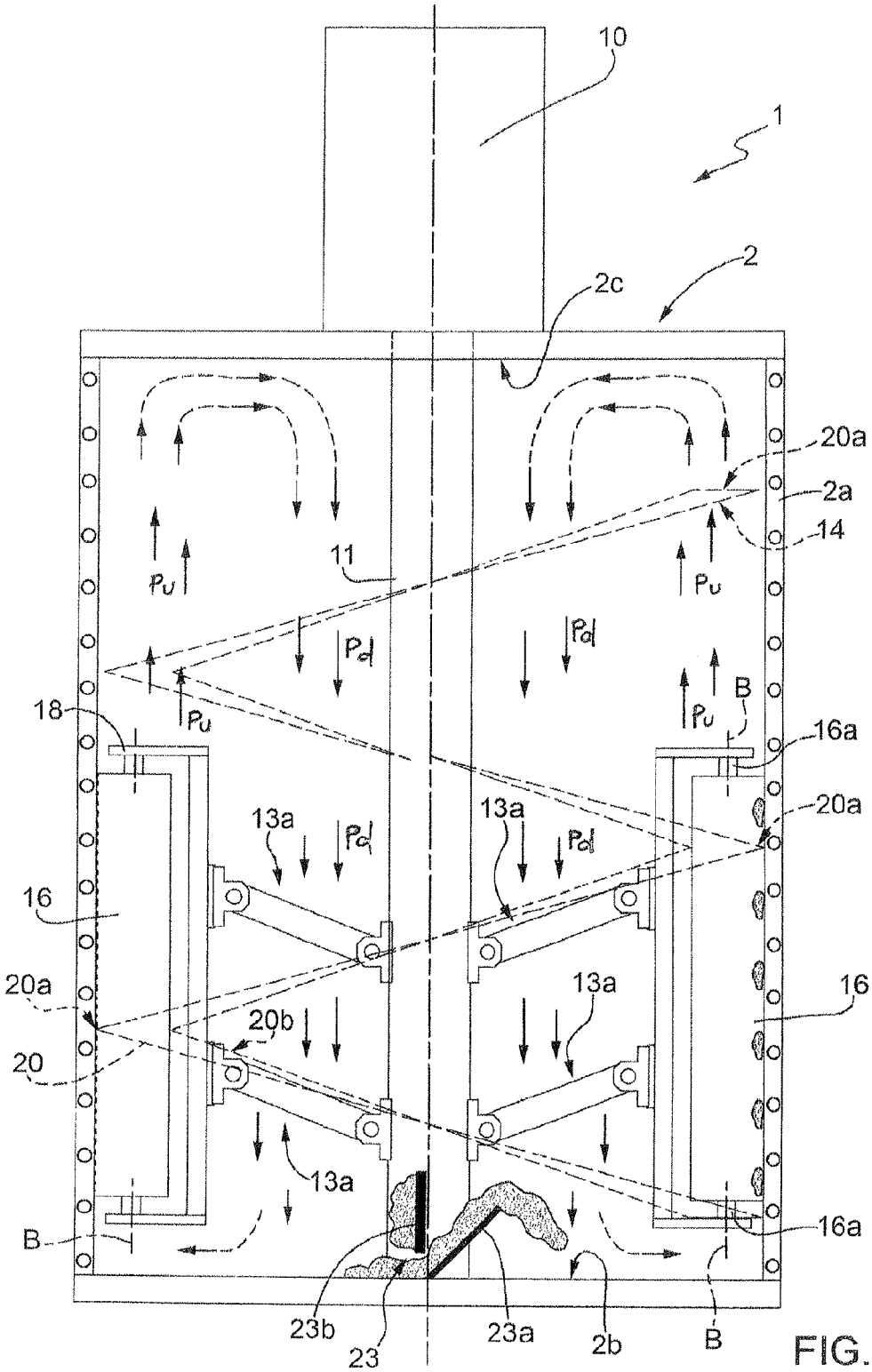

With reference to FIG. 4, once the driving unit 10 has been actuated, it rotates the mixing assembly 3 about the axis A, while the heating circuit 4 generates the heat which heats the inner surface 2*a* of container 2 so as to lead the components to a determined melting/dissolving temperature.

During this step, the components of the bituminous mix are lifted upwards, i.e. towards the surface 2*c*, by the rotation of the helicoidal blade 20. During this step, the rotation of the helicoidal blade 20 further subjects the components of the mix to a centrifugal force which tends to push them towards the inner surface 2*a* of container 2. In particular, during the rotation of the helicoidal blade 20, the solid granules having a higher specific weight than the remaining material conveniently tend to be accumulated on surfaces 2*a*.

At this point, the rotation of pressure rollers 16 on surface 2*a* causes the crushing of the solid granules accumulated at the surface 2*a* itself, and at the same time the rotation of the helicoidal blade 20 determines the scraping of the crushed solid granules adhering onto surface 2*a*. Thereby, the crushed solid granules are thus detached from the surface 2*a* and gradually pushed upwards by the helicoidal blade 20.

Furthermore, during this step, the scraping blade 23 is also rotated, which conveniently scrapes the bottom surface 2*b* of container 2, thus canceling all possibilities of settling the bituminous mix or components thereof on the surface 2*b*.

The rotation of the helicoidal blade 20 clearly also determines a convenient mixing of the different components, in addition to the action of scraping the inner surface 2*a*, the action of lifting the components upwards, and the action of pushing the granules outwards.

It is worth specifying that the motion impressed to the bituminous mix within the container has an ascending component deriving from the action of the helicoidal blade 20 and a descending component associated with the convective motion of the mix itself. In particular, the helicoidal blade 20 moves the bituminous mix from the bottom surface 2*b*, along a vertical upward path Pu, towards the upper surface 2*c*. Once the bituminous mix has reached the upper surface 2*c*, by virtue of a convective motion, it follows a downward path Pd which crosses the central non-intercepting volume of the mix towards the bottom surface 2*b*.

The convective downward motion of the mix is generated by the temperature differential of the mix present in the container, which clearly has an appreciably lower temperature in the central part than the mix at the surface 2*a*.

The above-described mixing machine 1 has several advantages.

First, the presence of the pressure rollers allows to perform a homogenous mechanical crushing of the solid granules regardless of the toughness thereof, thereby determining both a high homogenisation of the bituminous mix and thus an excellent quality thereof, and a reduction of the thermal energy required for dissolving the components.

In this case, laboratory tests demonstrated that the introduction of mechanical crushing of granules allows to remarkably reduce the total electric power employed. More in detail, the above-described machine requires an electric power of about 30 kW, while the electric powers employed in currently known mixing machines is typically higher than 75 kW.

Second, the presence of the helicoidal blade increases the degree of homogenisation of the components, in addition to keeping the inner surface of the container constantly clean, with obvious advantages in terms of reduction of maintenance and cleaning operations of the container.

It is worth adding that the scraping action performed by the helicoidal blade is advantageous even from the point of view of energy consumption because it prevents the formation of a surface layer of material on the inner surface. Indeed, such a layer would act as a thermal insulation, thus reducing the conduction heat exchange between the inner surface and the mix, thus determining a major reduction of the machine efficiency.

In addition to the above, the use of the scraping blade also allows to advantageously shape the container with a flat bottom surface instead of the tapered surface present in known mixing machines, thus allowing any sizing of the container in terms of diameter and height, and obtaining a volume however having the standard capacity required by the market.

In particular, by virtue of the use of the scraping blade, the container may be dimensioned so as to have an inner diameter of about 2000 mm and a height of 3500 mm, and thus a capacity of about 10 cubic meters, indeed corresponding to the standard capacity required by the market. Laboratory tests demonstrated that a better thermal efficiency and a more effective mixing are determined by reducing the aforesaid dimensions of the container and increasing its height/diameter ratio.

It is finally apparent that changes and variations may be made to the machine described and illustrated herein, without departing from the scope of the present invention.

The invention claimed is:

1. A bitumen mixing machine operable to mix a liquid mixture containing bitumen with solid granules so as to obtain a homogenised liquid bituminous mix, said machine comprising:

a cylindrical container arranged coaxially to a vertical axis and operable to contain said liquid mixture containing bitumen and said solid granules;

heating means operable to heat the inner surface of the side wall of said cylindrical container;

a mixing assembly which is mounted axially rotatable within said container to rotate about said vertical axis;

a driving unit operable to rotate said mixing assembly about said vertical axis;

said mixing machine being characterized in that said mixing assembly comprises:

scraper means comprising a helicoidal blade extending coaxial to said axis within said container and has its outer peripheral edge in contact with said inner surface of said container so as to scrape the material adhering on the inner surface; and crushing means, which are structured to mechanically crush said solid granules against said inner surface of said container, said crushing means comprise at least one pressure roller, which is arranged in abutment with its outer cylindrical surface on the inner surface of the container and, during rotation of said mixing assembly rotates about an axis parallel to said vertical axis so as to crush the solid granules against the inner surface of the container.

2. The machine according to claim 1, wherein said helicoidal blade is profiled so as to have its inner peripheral edge spaced from said vertical axis.

3. The machine according to claim 1, wherein said helicoidal blade develops along said vertical axis so as to cover the entire height of said container, and has a width smaller than the radius of the container.

4. The machine according to claim 1, comprising a central hub arranged coaxial to the vertical axis within said container, and wherein a pressure roller has ends hinged on a support bar connected to said central hub through a mechanical leverage, which is structured to allow the support bar to shift on a radial plane passing through said vertical axis, from and towards said inner surface of the container.

5. The machine according to claim 1, wherein the bottom surface of said container is flat and coplanar to a plane perpendicular to said vertical axis;

said scraper means comprising a scraper blade, which is stably connected to the central hub and is arranged resting on the bottom surface of said container so as to perform a scraping of the bituminous mix and/or of the components deposited on the surface.

6. The machine according to claim 1, wherein said helicoidal blade comprises a number of flat segments, which are arranged one after the other according to a helicoidal curve, are stably joined one to another at their ends and are intercalated between said pressure rollers.

7. The machine according to claim 1, wherein said helicoidal blade rotates about the vertical axis to move at least one portion of the mass of bituminous mix present at the surface of the container, from the bottom surface of the container to the upper surface opposite thereto, so as to mix the bituminous mix.

* * * * *